US012807388B2

(12) United States Patent
Guner et al.

(10) Patent No.: US 12,807,388 B2
(45) Date of Patent: Nov. 24, 2026

(54) INFLATABLE, FOLDABLE, PORTABLE, VACUUM APPLICABLE MULTI-USE CARGO PALLET IN AIR AND LAND CARGO TRANSPORTATION

(71) Applicants: Ali Ihsan Guner, Istanbul (AR); Cem Seyidir, Hong Kong (HK)

(72) Inventors: Ali Ihsan Guner, Istanbul (AR); Cem Seyidir, Hong Kong (HK)

( * ) Notice: Subject to any disclaimer, the term of this patent is extended or adjusted under 35 U.S.C. 154(b) by 37 days.

(21) Appl. No.: 18/995,989

(22) PCT Filed: Oct. 24, 2023

(86) PCT No.: PCT/TR2023/051187
§ 371 (c)(1),
(2) Date: Jan. 17, 2025

(87) PCT Pub. No.: WO2024/112292
PCT Pub. Date: May 30, 2024

(65) Prior Publication Data

US 2026/0048920 A1 Feb. 19, 2026

(30) Foreign Application Priority Data

Nov. 25, 2022 (TR) ..... 2022/017837

(51) Int. Cl.
*B65D 88/24* (2006.01)
*B65D 81/05* (2006.01)
(Continued)

(52) U.S. Cl.
CPC ..... *B65D 81/052* (2013.01); *B65D 88/14* (2013.01); *B65D 90/34* (2013.01); *B65D 2205/00* (2013.01)

(58) Field of Classification Search
CPC ..... B65D 88/14; B65D 88/005; B65D 88/24; B65D 33/01; B65D 81/20; B65D 81/2007;
(Continued)

(56) References Cited

U.S. PATENT DOCUMENTS 3,000,418 A * 9/1961 Bitting ..... B60R 9/048 206/524.8
3,548,904 A * 12/1970 Mackell ..... E04H 15/20 52/2.21
(Continued)

FOREIGN PATENT DOCUMENTS

CN 203970016 U 12/2014
CN 104366934 A * 2/2015 ..... A45C 7/004
(Continued)

OTHER PUBLICATIONS

VRR's Inflatable AKE Container—Air7, 2020, Retrieved from: https://www.youtube.com/watch?v=ig9B-TQSgZ4.

*Primary Examiner* — Allan D Stevens
(74) *Attorney, Agent, or Firm* — Bayramoglu Law Offices LLC

(57) ABSTRACT

An inflatable, foldable, portable, and vacuum applicable multi-use cargo pallet facilitates the placement of the shipments in the pallet for air and land cargo transportation. The pallet includes: an upper cover located on a main body for providing security against external impacts and package losses during transportation; an upper extension part located on the main body, where the upper extension part folds and contracts when vacuum is applied; a zipper located on the upper extension part and preventing transition of gas and liquid; pressure reducing valves located on the main body and the upper cover, where the pressure reducing valves prevent the pallet from inflating and disrupting a cargo compartment at high altitudes, where a pressure drops; and
(Continued)

straps and belts, where the straps and the belts are attached to the main body and the upper cover.

7 Claims, 11 Drawing Sheets

(51) Int. Cl.
*B65D 88/14* (2006.01)
*B65D 90/34* (2006.01)

(58) Field of Classification Search
CPC ..... B65D 81/2023; B65D 81/2015; B65D 81/203; B65D 81/2038; B65D 77/225; A45C 2013/028; A45C 13/021; A45C 7/004; A45C 7/0081
USPC ..... 206/524.8; 141/7, 8; 383/3, 4
See application file for complete search history.

(56) References Cited

U.S. PATENT DOCUMENTS 3,552,466 A * 1/1971 Fairchilds ..... B65D 37/00 383/3
3,578,050 A * 5/1971 Weingarten ..... B65D 88/14 383/3
3,587,794 A * 6/1971 Mattel ..... A45C 7/004 383/3
4,044,867 A * 8/1977 Fisher ..... A45C 7/004 383/3
4,946,214 A * 8/1990 Neumann ..... B65D 88/522 410/58
6,135,253 A * 10/2000 Weissman ..... A45C 13/02 190/110
6,202,849 B1 * 3/2001 Graham ..... B65D 25/16 206/524.8
7,588,160 B2 * 9/2009 Chen ..... B65D 33/2508 220/723
10,968,012 B1 * 4/2021 Ward ..... B65D 11/1833
2002/0179468 A1 * 12/2002 Chen ..... B65D 85/30 206/320
2005/0155891 A1 * 7/2005 Chen ..... B65D 5/46016 206/524.8
2006/0237928 A1 * 10/2006 Vanderberg ..... B62B 3/10 280/35
2008/0237239 A1 * 10/2008 Pham ..... B65D 81/2038 53/469
2009/0080809 A1 * 3/2009 Pham ..... A45C 13/03 206/524.8
2011/0155611 A1 * 6/2011 Armstrong ..... A45C 7/004 220/4.01
2012/0124942 A1 * 5/2012 Shani ..... B05B 11/061 53/79
2013/0180816 A1 * 7/2013 Wytenhove ..... A45C 13/28 190/103
2013/0284734 A1 * 10/2013 Huang ..... B65D 11/22 220/9.4
2015/0089903 A1 * 4/2015 Carey ..... A45C 13/02 53/434
2020/0060400 A1 * 2/2020 Glaser ..... A45C 13/03
2021/0024276 A1 * 1/2021 Bradley ..... A45C 13/36
2024/0065400 A1 * 2/2024 Majhess ..... A45C 15/00

FOREIGN PATENT DOCUMENTS

CN 107467837 A * 12/2017 ..... A45C 5/04
CN 209834479 U 12/2019
CN 212829858 U 3/2021
CN 112660594 A 4/2021
CN 213009536 U 4/2021
CN 217599307 U 10/2022
DE 1786205 A1 * 1/1972
DE 102014003210 B3 * 5/2015 ..... B65D 90/16
DE 202015003128 U1 * 8/2015 ..... B65D 25/101
EP 0802121 A1 * 10/1997 ..... A45C 7/004
EP 3705420 B1 * 12/2021 ..... B65D 88/14
FR 2912997 A1 * 8/2008 ..... B65D 21/086
JP 2005298035 A * 10/2005
JP 2006321511 A * 11/2006
KR 101017750 B1 * 1/2011 ..... B65D 81/2038
SE 534463 C2 * 8/2011 ..... B65D 90/205
TW i644838 B * 12/2018
WO WO-2021165808 A1 * 8/2021 ..... B65D 81/2038

* cited by examiner

INFLATABLE, FOLDABLE, PORTABLE, VACUUM APPLICABLE MULTI-USE CARGO PALLET IN AIR AND LAND CARGO TRANSPORTATION

CROSS REFERENCE TO THE RELATED APPLICATIONS

This application is the national phase entry of International Application No. PCT/TR2023/051187, filed on Oct. 24, 2023, which is based upon and claims priority to Turkish Patent Application No. 2022/017837, filed on Nov. 25, 2022, the entire contents of which are incorporated herein by reference.

TECHNICAL FIELD

The invention relates to an inflatable, foldable, portable, and vacuum applicable multi-use cargo pallet that facilitates the placement of the shipments in the pallet for air and land cargo transportation.

BACKGROUND

In air cargo transportation, pallets are currently supported from the bottom, they cannot be placed in a certain rigid three-dimensional enclosure, the packages are stacked on pallets supported from the bottom and fastening and tied with materials such as nylon and mesh. In this case, the pallet cannot be formed in the appropriate geometry and the cargo volumes of the vehicles cannot be used efficiently.

Cargo and mail revenues are among the most important income sources that affect the profitability of airlines. When air cargo transportation is examined, the unit cubic meter and weight fee is the most expensive mode of transportation according to all transportation methods. In air cargo transportation with the highest unit cost, each additional weight that can be transported has a great impact on the volume's profitability of the flight. For this reason, it is aimed for airlines to carry as much cargo and mail as possible within the aircraft limits. There are two limits within the aircraft for cargo and mail loading to aircraft. These are the maximum weight the aircraft can lift and the cargo and mail loading volume/capacity inside the aircraft. According to the International Air Transport Association (IATA) definition, which determines the standards of aviation, it is foreseen and defined that 166 kg of cargo or mail can be loaded in one cubic meter of space.

In today's aircraft, the volume capacity in the aircraft is more restrictive than the two-distance related limits. Airplanes can carry up to 400 kg of cargo and mail per cubic meter, depending on the distance. As stated, 166 kg of cargo is expected to be placed for one cubic meter of air cargo transportation. Accordingly, the definitions in the industry are given below.

1 $m^3$>166 kg means, volumetric cargo,

1 $m^3$<166 kg means, dense cargo.

As can be understood from these definitions, in order to increase cargo transportation revenues, effective loading of cargo to the pallet position inside the aircraft or cargo vehicle is the main factor that increases profitability.

When irregularly shaped shipments (such as mail bags) are loaded on airline pallets, they cannot be placed on top of each other like box shipments on the pallet, and they slip and fall over each other.

As an example, take "Station A" of air or land carrier:

Case 1: In case there are not enough containers at Station A, land transporters or airlines should take empty containers from their central stations for their shipments departing from point A. However, there is not always cargo available to carry arriving at Station A from the central station. In this case, the containers are shipped to point A as half full and/or empty. In other words, transporting containers instead of cargo causes loss of income.

Case 2: If there are more containers than needed at Station A, land carriers or airlines need secure and large storage terminals to store their containers.

The above-mentioned cases increase the operational expenses and decrease the revenues of airlines and land transporters.

In the known state of the art, Utility Model CN213009536U refers to an inflatable carrying bag consisting of an outer bag and an inner bag, which is related to the field of logistics. With our invention, the necessity of using double bags has been eliminated.

In the known state of the art, Utility Model CN203970016U describes a vacuum compression bag. The problem that the shape of the bag body is not flat after performing air removal in an existing compression bag has been resolved with our invention.

In the known state of the art, Chinese patent document CN112660594A describes a square shaped three-dimensional vacuum compression bag.

When the existing studies in the art were examined, it was necessary to realize an inflatable, deflatable, foldable, vacuum applicable, multi-use cargo pallet that provides efficient placement of shipment packages by creating a defined volume in the pallet thanks to its side walls that harden when inflated, reduces the loss of volume in the pallet, can be manufactured in different sizes according to the cargo volumes of the vehicles, reduces the total volume by compressing the packages by applying vacuum after the packages are placed, can be folded by evacuating the air, can be stored in this way, and can be transported between cargo centers.

SUMMARY

The objective of the present invention is to create an inflatable, deflated, foldable, vacuum applicable multi-use cargo pallet that can be manufactured in different sizes according to the cargo volumes of the vehicles, that reduces the total volume by compressing the packages by applying vacuum after the packages are placed, that can be folded by evacuating the air, that can be stored in this way, and that can be transported between cargo centers by creating a defined volume in the pallet thanks to its side walls that harden when inflated.

Another object of the invention is to increase the profitability of cargo and mail transportation made with pallets in air and land transportation, by increasing the loading efficiency on the basis of pallets in terms of time, volume and weight.

Another objective of the invention is the realization of a cargo pallet that benefits cargo and logistics activity, reduction of carbon footprint and protection of the environment.

BRIEF DESCRIPTION OF THE DRAWINGS

The inflatable, foldable, portable, vacuum-applicable multi-use cargo pallet realized to achieve the objects of the present invention is shown in the accompanying figures.

These figures are.

Figure 1:
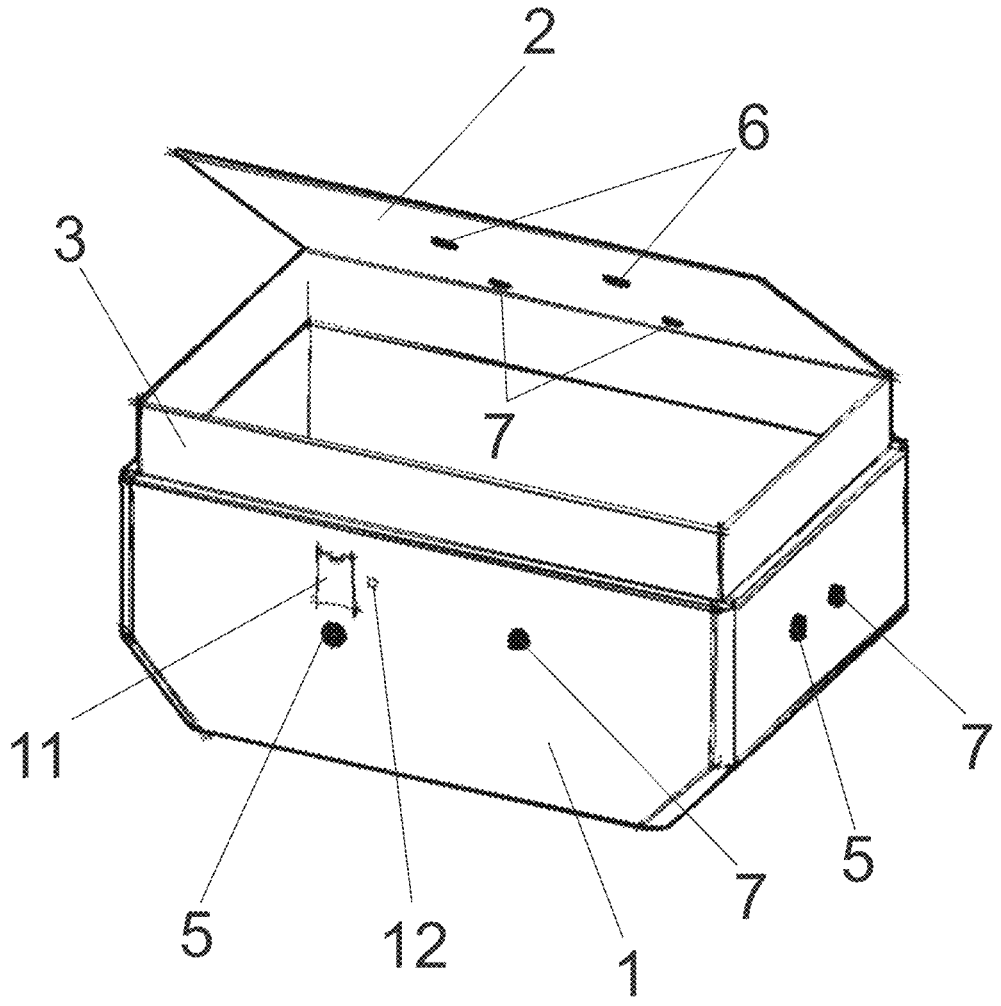
FIG. 1: Perspective view of the pallet.
Figure 2:
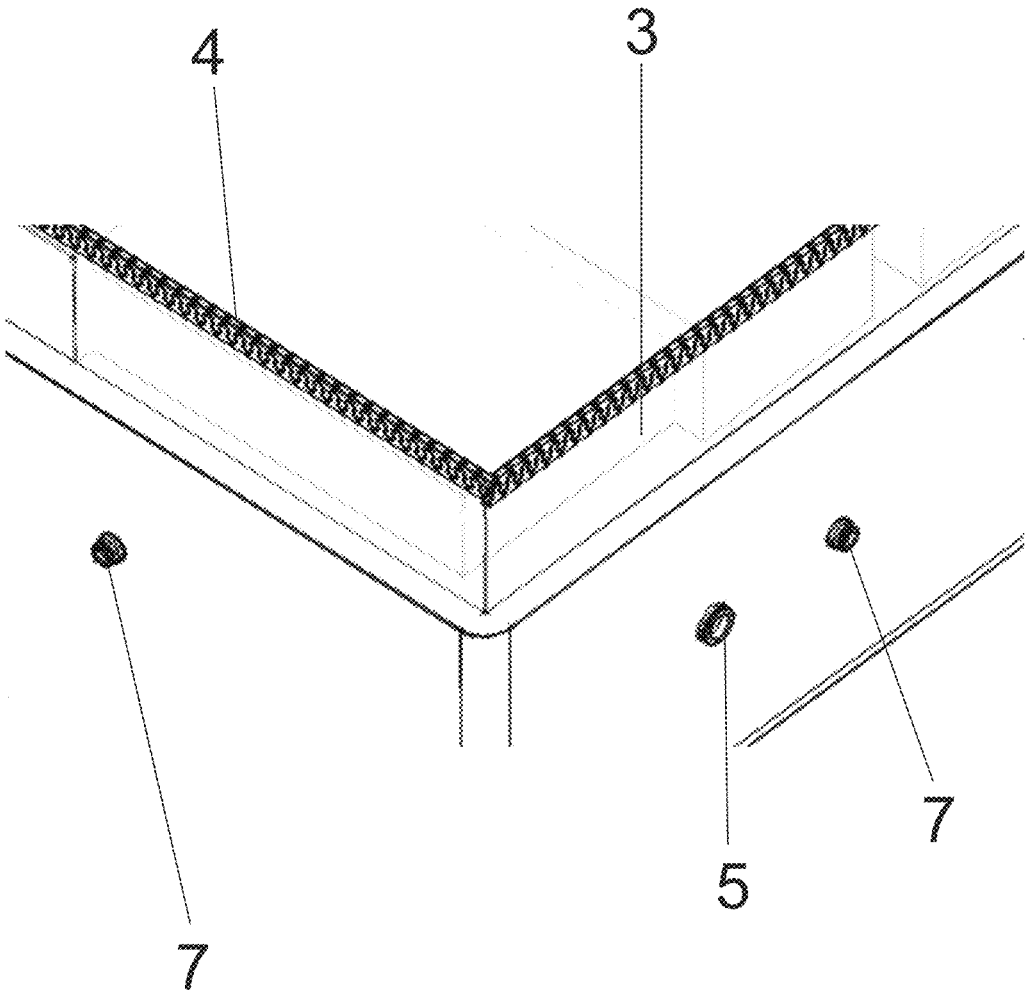
FIG. 2: Detailed view of the upper extension part of the pallet.
Figure 3:
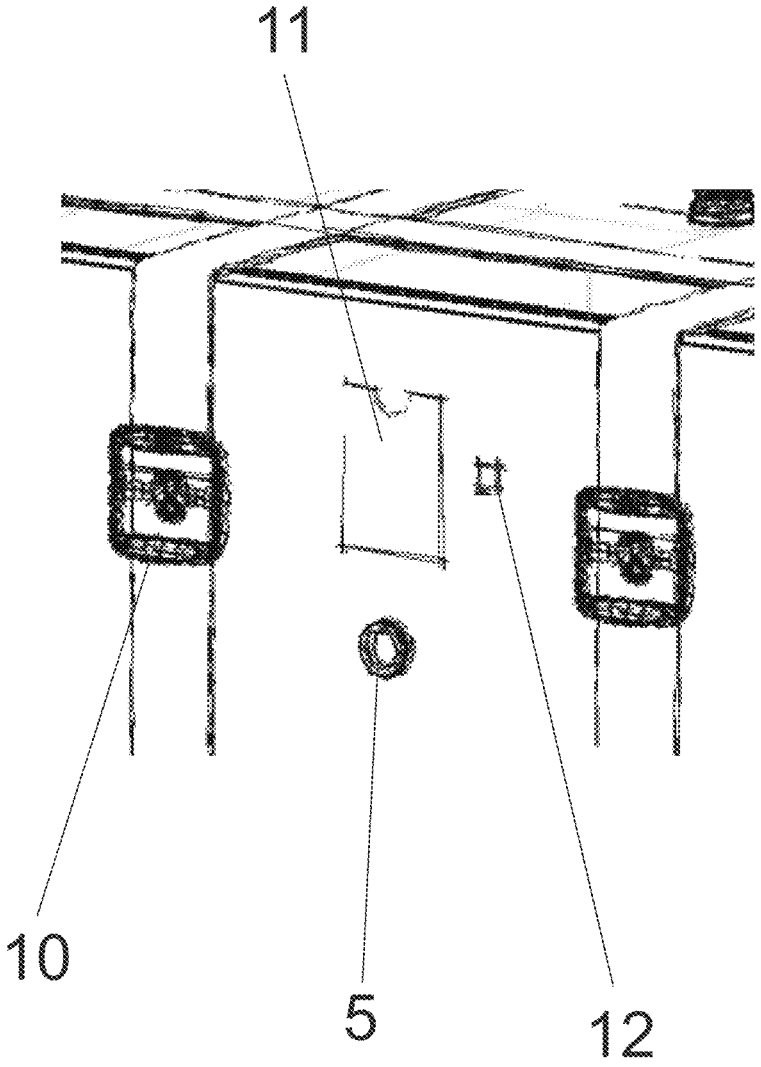
FIG. 3: Detailed view of the information pockets part of the pallet.
Figure 4:
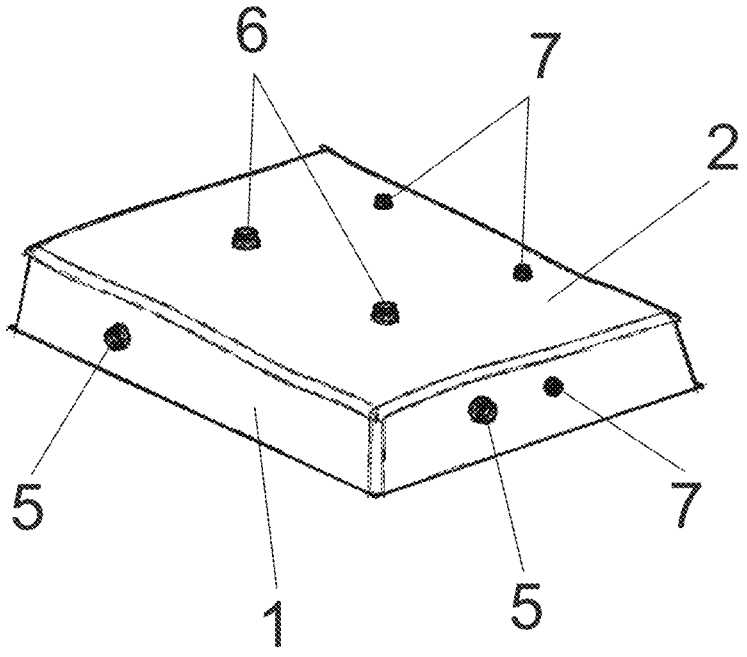
FIG. 4: A view of the un-inflated, deflected position view of the pallet.
Figure 5:
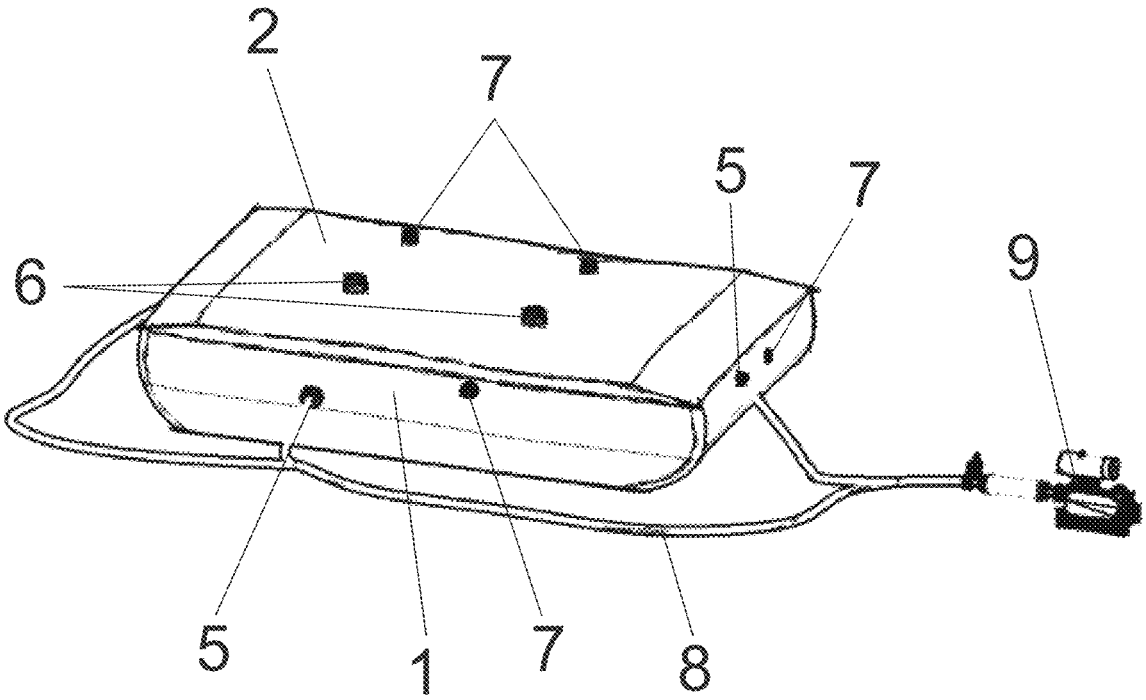
FIG. 5: A view of the cargo pallet in the inflated state.
Figure 6:
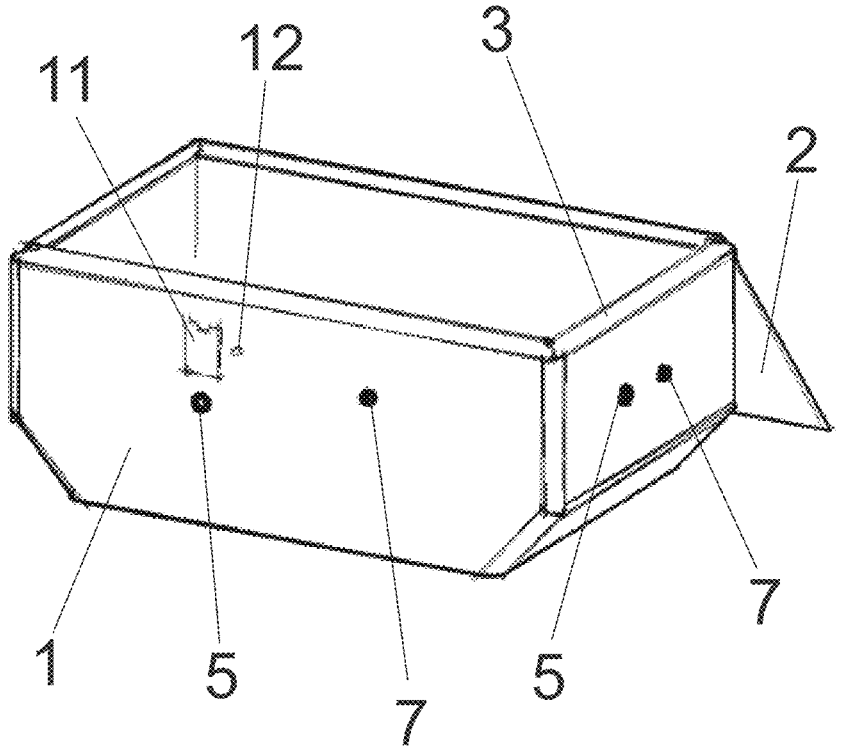
FIG. 6: A view of the cargo pallet after it has been inflated.
Figure 7:
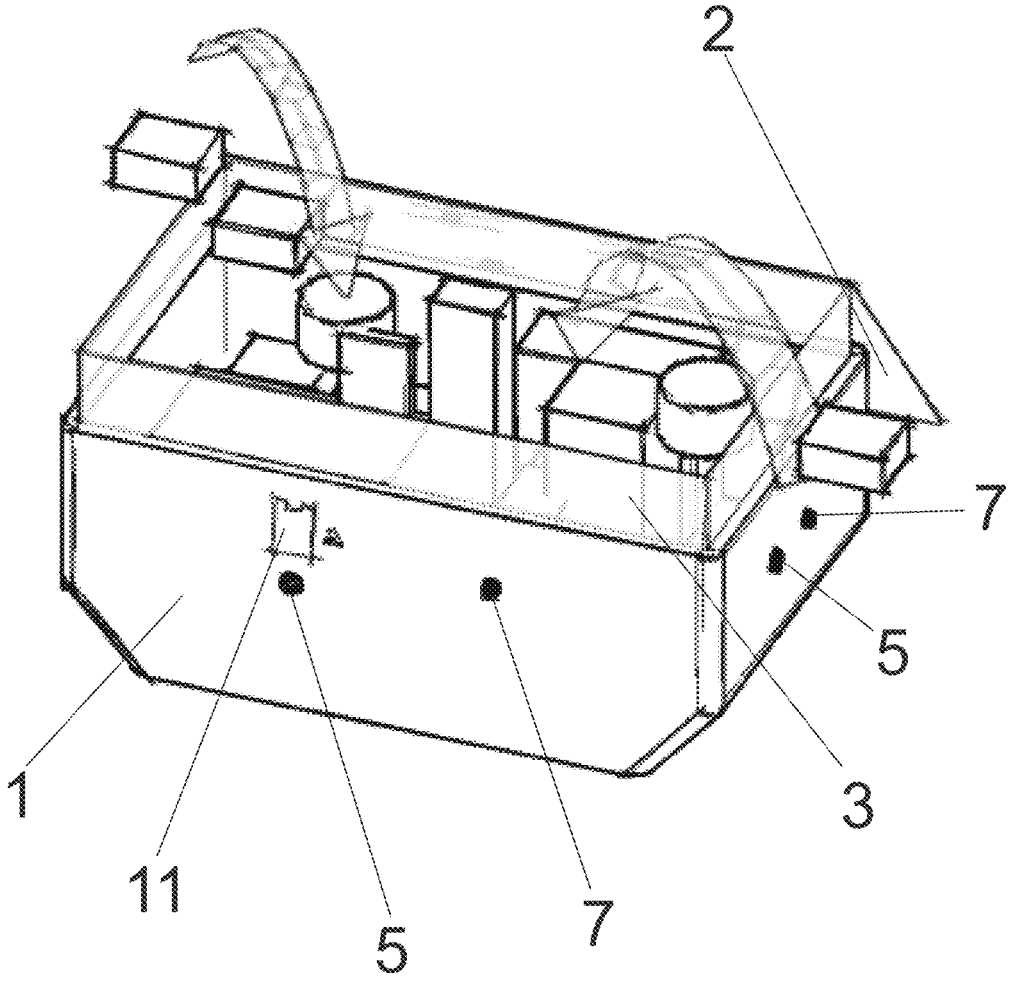
FIG. 7: A view of the cargo pallet when the package is placed in it.
Figure 8:
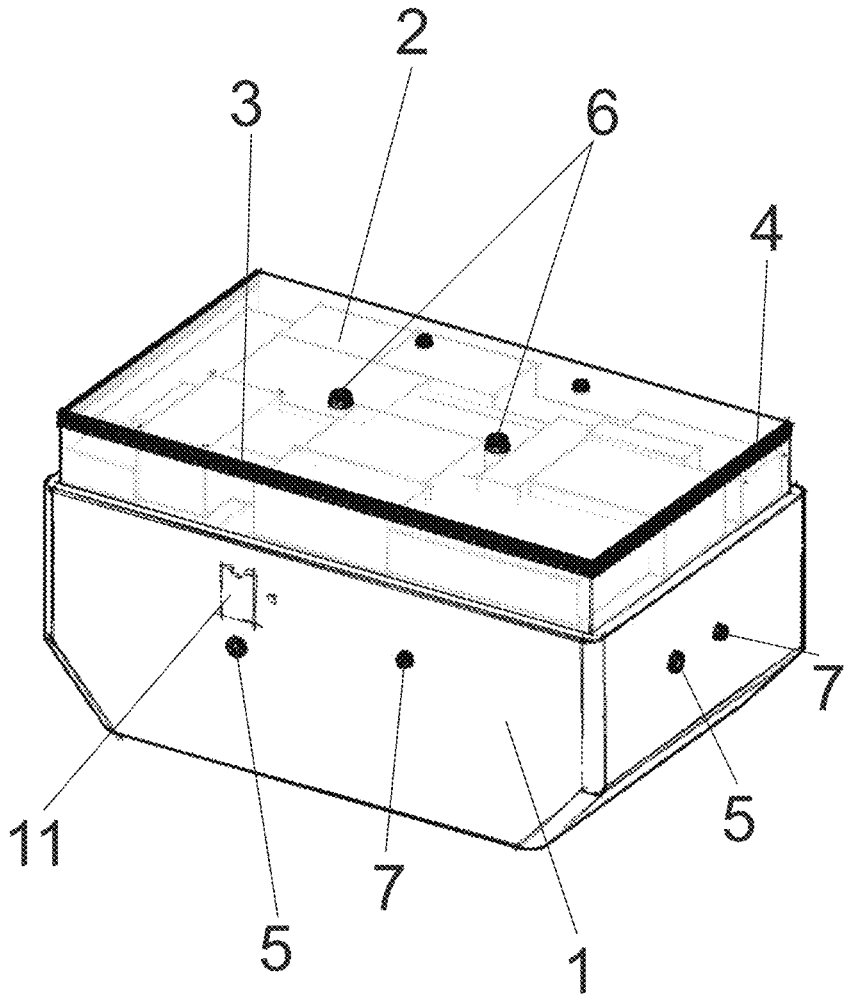
FIG. 8: A view of the cargo pallet after the package is placed inside and closed.
Figure 9:
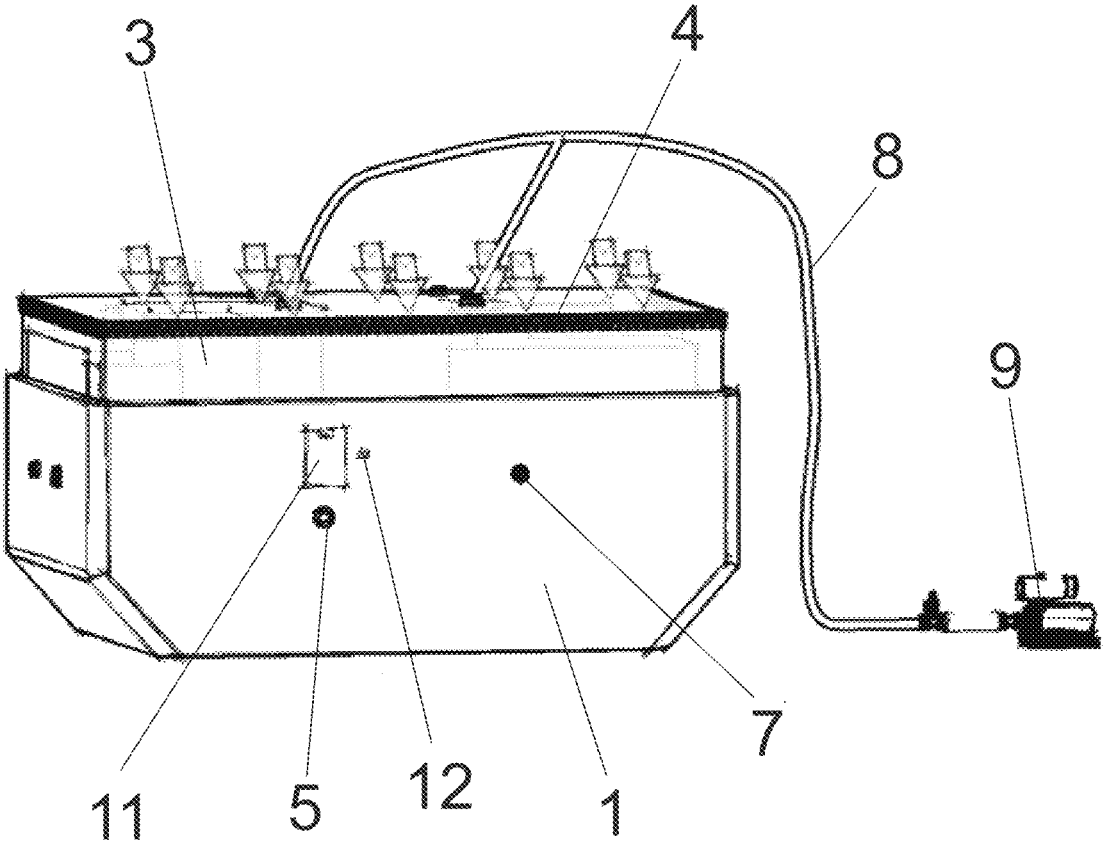
FIG. 9: A view of the cargo pallet in the state in which vacuum application is performed.
Figure 10:
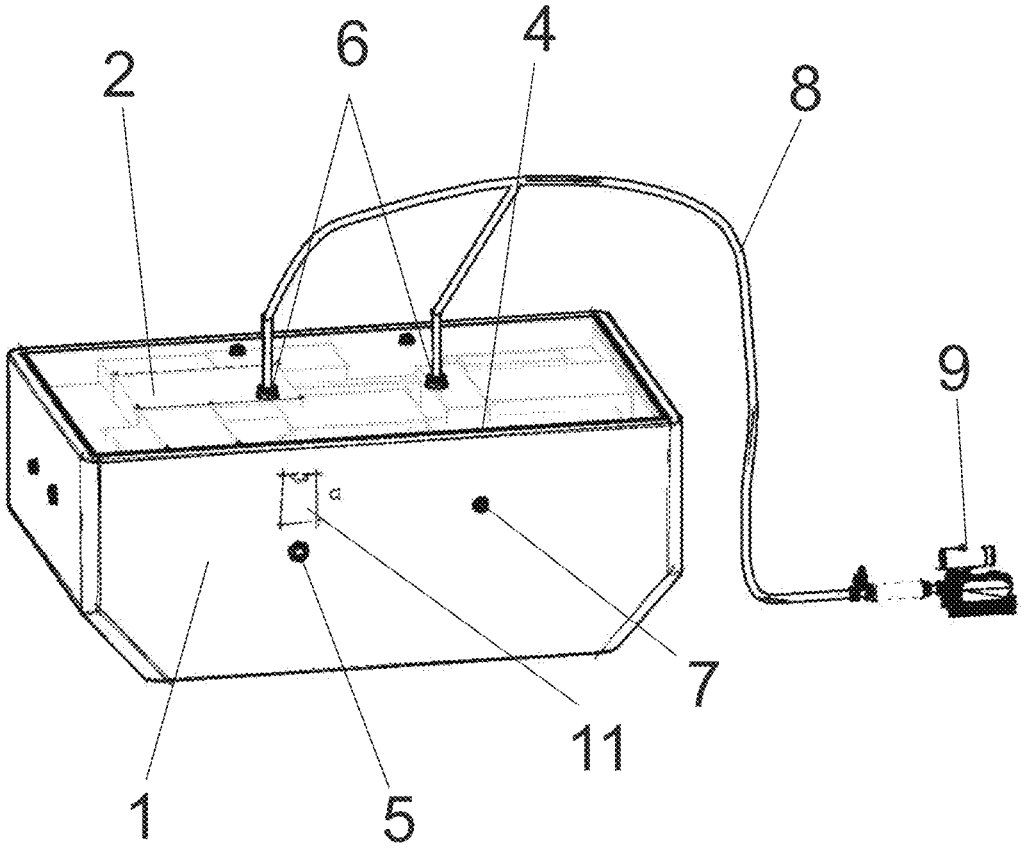
FIG. 10: A view of the cargo pallet after the vacuum application is finished.
Figure 11:
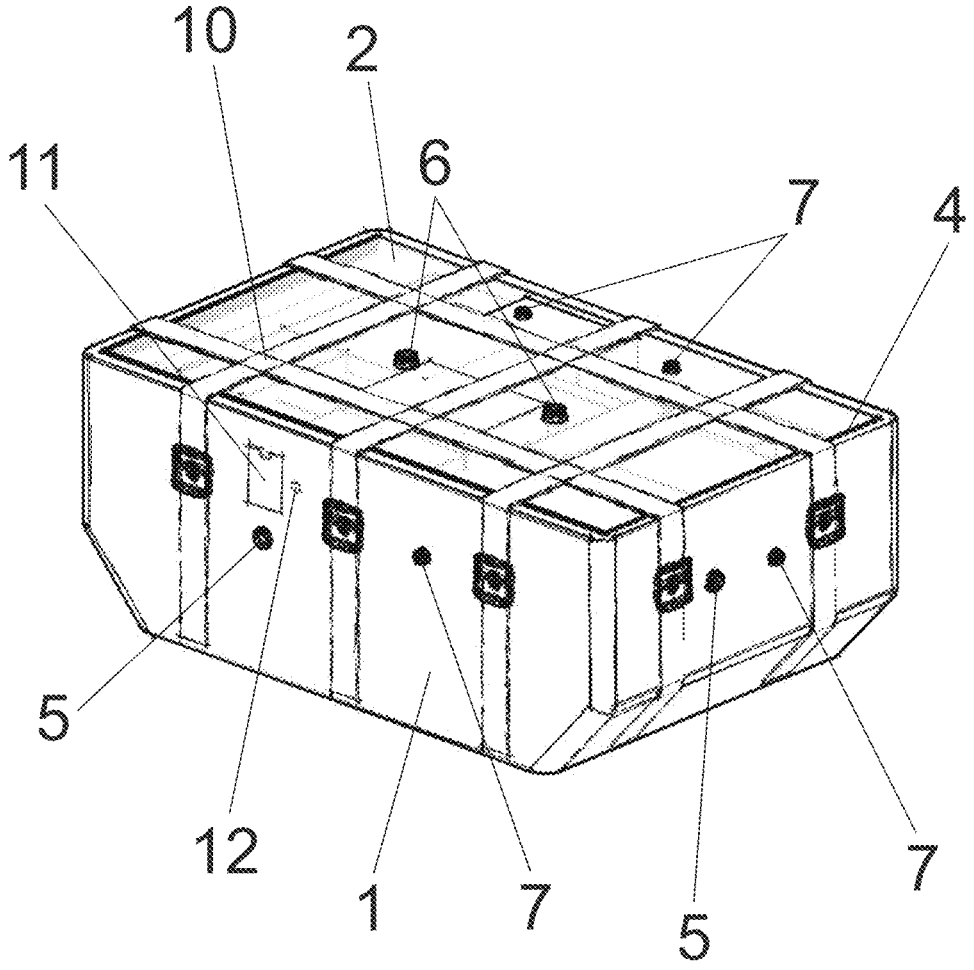
FIG. 11: A view of the cargo pallet after the vacuum application is finished and when the straps and belts are attached.

The parts in the figures are individually numbered, and the definitions of the of the parts corresponding to the numbers are given below.

13. Main body
14. Upper cover
15. Upper extension part
16. Zipper
17. Inflation valves
18. Vacuum valves
19. Pressure reducing valves
20. Inflation and vacuum hose
21. Inflation and vacuum pump
22. Straps and belts
23. Document pocket
24. AirTag™ pocket

DETAILED DESCRIPTION OF THE EMBODIMENTS

The invention relates to an inflatable, foldable, portable, vacuum applicable multi-use cargo pallet comprises the following parts.

The top cover (2), which is located on the main body (1) and provides security against external impacts and package losses during transportation.

The upper extension part (3) located on the main body (1), which folds and contracts when vacuum is applied, ensuring the compression and squeezing of the packages.

Zipper (4) located on the upper extension (3) which prevents the transition of gas and liquid.

Inflation valves (5), which are located on the main body (1) and allowing the pallet to be inflated.

Vacuum valves (6) located on the upper cover (2) and allowing the air in the pallet to be removed.

Pressure reducing valves (7), located on the main body (1) and the upper cover (2), which prevents the pallet from inflating and disrupting the cargo compartment at high altitudes, where the pressure drops.

Inflation and vacuum hoses (8) and inflation and vacuum pump (9), which provide air pressure and vacuum application into the pallet through the main body (1) and the upper cover (2).

Straps and belts (10) that are attached to the main body (1) and the upper cover (2), which prevent the pallet from deteriorating during transportation after the pallet is deflated and its vacuum is removed.

Document pocket (11) on the main body (1) where the user manual or cargo information can be placed.

AirTag™ (tracking device) pocket (12) located on the main body (1) and allowing pallet tracking by placing a tracking device or a Global Positioning System (GPS)-like equipment. An AirTag™ is a tracking device.

The double-walled inflatable main body (1) provides the structural integrity in which the packages will be placed and can be manufactured in different sizes and geometries to adapt to different cargo loading bays.

The usage steps of the cargo pallet, which is the subject of the invention, is explained below.

The pallet, which is stored in a folded state, is taken from its place and transferred to the place where it will be prepared, and it is opened from the folded state.

First, the inflation and vacuum hoses (8) are connected to the inflation valves (5) on the main body (1).

The inflation and vacuum pump (9) is connected to the inflation and vacuum hoses (8).

Air is pumped into the double-walled main body (1) by the inflation and vacuum pump (9) and inflated.

The walls of the main body (1) are inflated, the air pumping process is completed, the inflation and vacuum hoses (8) are separated from the inflation valves (5) on the main body (1).

The pallet is ready to be filled. If required, documents can be placed in the document pocket (11) and a tracking device can be placed in the AirTag™ (tracking device) pocket (12).

Inside of the inflated pallet is filled with packages, cargoes. The top of the main body (1) is possible to be overfilled according to the compressibility of the packages and cargoes filled into the pallet. Here, extra filling is possible thanks to the upper extension part (3).

The upper cover (2) is closed over the upper extension (3), the water and airtight zippers (4) are completely closed.

The inflation and vacuum hoses (8) are connected to the vacuum valves (6) on the upper cover (2).

Then vacuum is applied to the pallet with the inflation and vacuum pump (9). With vacuum, the packages and cargoes in the pallet are compressed, the upper extension (3) is completely folded. However, the pressurized double walls on the inflated main body (1) protect the pallet from being deformed.

The pallet, which is compressed by vacuum, is tightly fixed with belts and straps (10).

Then, the pressure reducing valves (7) on the main body (1) are opened in a controlled manner and the pallet is slowly deflated. While the main body (1) gradually deflates, the belts (10) continue to be tighten. In this way, deformations caused by deflation are prevented. In addition, a smaller size is obtained compared to the inflated pallet. In this way, more pallets can fit in the cargo compartments of the vehicles.

After the main body (1) is completely deflated and the belts (10) are tightened well, if the cargo is to be transported by air, the pressure reducing valves (7) on the upper cover (2) are also fully opened.

If the pallet is to be transported by air, it is checked that all pressure reducing valves (7) should completely open. In this way, in low pressure environments, the pallet is protected from swells and takes up space in the cargo compartment.

The pallet is ready to be transported and placed in the cargo compartment of the vehicles.

The cargo pallet, which is the subject of the invention, creates a suitable rigid volume where the packages can be placed thanks to its inflatable walls, so that the packages can be placed quickly in the pallet without wasting space. The total cargo volume and weight of the transportation increase, and the loading time decreases.

The cargo pallet, which is the subject of the invention, can be manufactured in accordance with the geometry of the cargo compartments of the vehicles, for example, by making a winged design for the empty spaces in the lower-deck compartments of the aircraft, it is possible to load up to 13% more volume and weight than the normal loading.

After loading into the pallet, vacuum is applied to the pallet and compression is ensured, and the total volume is reduced by compressing the spaces inside the bulky cargoes and between the packages. In this way, it is possible to load more cargo into the pallet volume and thus to create a heavier pallet.

Since the cargo pallet is made of inflatable polyvinyl chloride (PVC), thermoplastic polyolefin (TPO) membrane and similar materials, It is multi-use.

It is lightweight.

It is durable.

It is easy to repair.

Due to its waterproof feature, it protects the packages inside the pallet from liquid damage during transportation. Disposable plastic sheets used in current applications for pallet formation are no longer needed and add benefits to sustainability.

Due to its lockable and sealable structure, it provides security for potential package losses in the pallet.

Due to its inflatable, deflatable, foldable, lightweight structure, it is easy to store and transport between cargo centers.

The lightweight, inflatable, deflatable and foldable structure of the invention overcomes the problems of handling and storage. Because if it is required to be shipped empty, it can be deflated and folded to be shipped and stored in small dimensions.

As it is up to 40% lighter than the metal or composite containers currently used in airlines, it reduces the take-off weight of the aircraft and causes less fuel consumption. It increases efficiency and sustainability compared to existing practices. The same is valid for containers used in land transportation.

In recent years, air cargo shipments of e-commerce, temperature-controlled pharmaceuticals and fragile products have increased and continue to increase. It is critically important that special products are delivered to their destination unharmed and undamaged. Each spoiled and damaged product increases the cargo footprint and increases all costs. Currently, shipments are not adequately and sustainably protected against liquid damage and thermal degradation on board and at cargo terminals. As stated in the reports of IATA, the damage to these sensitive products usually occurs while the aircraft is in the loading/unloading process in the landing and take-off area (RAMP area). Disposable plastic sheets are currently used to prevent these damages. The cargo pallet, which is the subject of the invention, prevents damage and deterioration of the shipping packages with its waterproof structure, if required temperature-controlled structure by using heat-insulating fabric. Thus, both the damage to the shipments are prevented and the use of extra plastic disposable sheets are eliminated. In addition to its cost advantage, its multi-usability feature gives.

What is claimed is:

1. An inflatable, foldable, portable, vacuum-applicable multi-use cargo pallet, comprising:

an upper cover, wherein the upper cover is located on a main body and provides security against external impacts and package losses during transportation, an upper extension part located on the main body, wherein the upper extension part folds and contracts when vacuum is applied, ensuring compression and squeezing of packages, a zipper located on the upper extension part and preventing transition of gas and liquid, a plurality of pressure reducing valves located on the main body and the upper cover, the plurality of pressure reducing valves including at least one pressure reducing valve located on the main body and at least one pressure reducing valve located on the upper cover, wherein, when open, the plurality of pressure reducing valves prevent the pallet from inflating and disrupting a cargo compartment at high altitudes where pressure drops, and straps and belts, wherein the straps and the belts are attached to the main body and the upper cover, and prevent a structure and a shape of the pallet from deformation during transportation after the pallet is deflated and a vacuum of the pallet is removed.

2. The inflatable, foldable, portable, vacuum applicable multi-use cargo pallet according to claim 1, further comprising inflation valves (5) located on the main body and allowing the pallet to be inflated.

3. The inflatable, foldable, portable, vacuum applicable multi-use cargo pallet according to claim 2, further comprising vacuum valves located on the upper cover and allowing air to be taken out in the pallet.

4. The inflatable, foldable, portable, vacuum applicable multi-use cargo pallet according to claim 3, further comprising inflation and vacuum hoses and an inflation and vacuum pump, wherein the inflation and vacuum pump is configured to pump air through pallet walls into the main body and to vacuum air through the upper cover.

5. The inflatable, foldable, portable, vacuum applicable multi-use cargo pallet according to claim 4, further comprising a document pocket located on the main body, wherein user manual or cargo information is placed in the document pocket.

6. The inflatable, foldable, portable, vacuum applicable multi-use cargo pallet according to claim 5, further comprising a tracking device pocket located on the main body, wherein the tracking device pocket allows cargo tracking by placing a tracking device or a GPS-like equipment.

7. The inflatable, foldable, portable, vacuum applicable multi-use cargo pallet according to claim 6, wherein a structure of the main body is inflatable double-wall.

* * * * *